United States Patent [19]

McGhie

[11] 3,933,271

[45] Jan. 20, 1976

[54] CAPTIVE CAP

[75] Inventor: Russell Park McGhie, Somers, N.Y.

[73] Assignee: Colgate-Palmolive Company, New York, N.Y.

[22] Filed: Feb. 14, 1974

[21] Appl. No.: 442,439

[52] U.S. Cl. ..... 220/335; 220/339; 222/498; 222/517; 222/556

[51] Int. Cl.[2] ..... B65D 43/24

[58] Field of Search ..... 220/334, 335, 336, 337, 220/339, 340, 341, 342, 375; 222/543, 544, 556, 562, 517, 498

[56] References Cited

UNITED STATES PATENTS

| | | | |
|---|---|---|---|
| 1,928,445 | 9/1933 | Boyd | 220/335 |
| 1,980,853 | 11/1934 | Dietze | 220/335 |
| 2,121,913 | 6/1938 | Hartog | 220/335 |
| 2,583,350 | 1/1952 | Witzgall | 220/335 |
| 3,416,655 | 12/1968 | Shiffman | 220/335 |
| 3,548,446 | 12/1970 | Hocq | 220/335 |
| 3,741,447 | 6/1973 | Miles | 220/339 |

*Primary Examiner*—William I. Price
*Assistant Examiner*—Ro E. Hart
*Attorney, Agent, or Firm*—Herbert S. Sylvester, Esq.; Murray M. Grill, Esq.; Kenneth A. Koch, Esq.

[57] ABSTRACT

This invention relates to an integrally molded captive cap assembly including a threaded base for attachment to a container and a lead tube which projects into a hollow cap which is pivotally connected to the base. An integrally molded pair of spring members are disposed between the cap and the base and have end portions pivotally connected to the base and to the cap. The spring members bias the cap toward one of two positions. When the cap is in a closed position, the spring members bias the cap toward the closed position and when the cap is opened past an intermediate position, the spring members bias the cap toward an open position.

9 Claims, 7 Drawing Figures

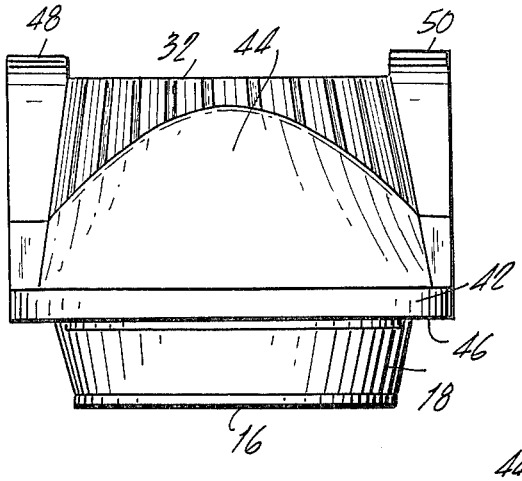
FIG. 4
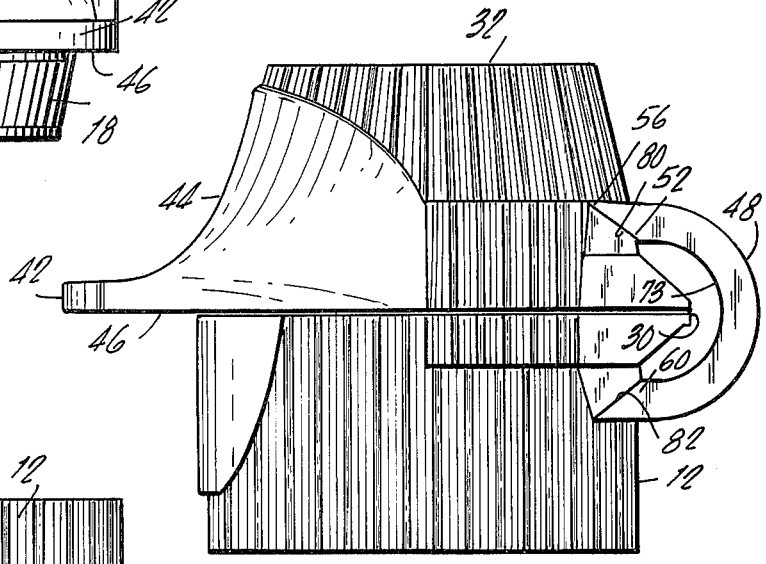
FIG. 7
FIG. 5
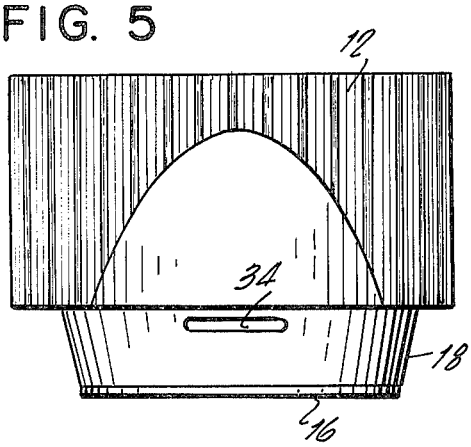
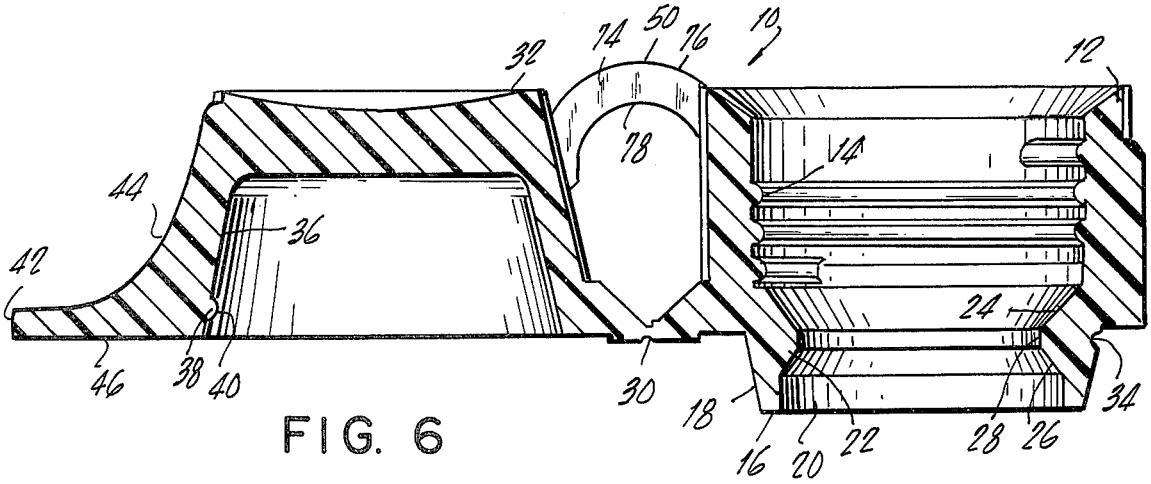
FIG. 6

CAPTIVE CAP

BACKGROUND OF THE INVENTION

FIELD OF THE INVENTION

This invention relates to cap type closures for containers. More particularly, the invention relates to captive caps.

DESCRIPTION OF THE PRIOR ART

Conventional caps for flexible toothpaste tubes, and tubes containing similar semi-solid substances, comprise a hollow member having an internally threaded portion which is secured to the flexible tube by threading onto an externally threaded portion of the tube. When a product such as toothpaste is used this conventional cap is removed from the tooth paste tube and put aside while the tooth paste is extruded from the tube by the user. The user then breaks off the extruded tooth paste onto the bristles of a tooth brush and replaces the cap. Although this type of conventional cap closure is in wide use, there are several inherent disadvantages present in this type of cap closure including the following: Conventional caps are relatively small and consequently are difficult to manipulate, especially by children, and easily become lost; Conventional caps when used on tooth paste tubes can readily fall into a bathroom sink drains causing drainage problems; Conventional caps are generally messy because the extruded toothpaste can not be wiped off the externally threaded portion of the tooth paste tube cleanly by the tooth brush bristles with the result that the tooth paste is transferred to and collects within the external threads of the toothpaste tube and the internal threads of the cap and this results in a messy unit which becomes progressively messier with continued use; and conventional caps generally require two hands to open and close the container.

SUMMARY OF THE INVENTION

The present invention overcomes the problems of the prior art by providing an integrally molded captive cap assembly including a threaded base for attachment to a toothpaste tube and a lead tube which projects into a hollow cap which is pivotally connected to the base. An integrally molded pair of spring members are disposed between the cap and the base and are pivotally connected to the base and the cap. The spring members bias the cap toward one of two positions. When the cap is close to a closed position, the spring members bias the cap toward the closed position and when the cap is opened past an intermediate position, the spring members bias the cap toward an open position. When the cap is in the closed position, a protuberance in the cap fits within a recessed portion of the lead tube thus locking the cap and the base. An extended portion of the cap is provided in line with the hinge connecting the cap and the base to facilitate opening and closing the captive cap with one hand. Captive caps have been employed previously such as shown in U.S. Pat. No. 3,289,877 (Wolf). The spring members and the hinge portion of the captive cap according to the present invention have a resemblance to the integrally molded configuration of a unitary hinge according to U.S. Pat. No. 3,289,877 (Wolf). However, examination of the construction and the mode of operation of the spring members according to the present invention will reveal distinct differences between the configuration according to the present invention and the configuration according to U.S. Pat. No. 3,289,877 (Wolf). In U.S. Pat. No. 3,289,877 the spring member has an end portion which is rigidly connected, or built into, one of the two hinged members. This results in a complex bending mode occurring in the spring member when the hinge is flexed. The spring member of U.S. Pat. No. 3,289,877 has two distinct portions: a relatively thicker portion which functions as a cantilever spring in a bending mode, and a relatively thinner flexible member which acts primarily as a tension member to transmit the spring force. In practice this thinner member has some degree of stiffness or resilience and this tends to complicate the mode of action of the spring member.

In the present invention the cross-sections of the spring members are generally uniform and the connections between the spring member and both the cap and the base are hinges. The spring members according to the present invention undergo bending throughout their entire length when the cap is opened or closed thus resulting in a simpler mode of action than the spring members according to U.S. Pat. No. 3,289,877.

It is therefore an object of the present invention to provide a captive cap assembly incorporating a hinge portion between the cap and a base portion which has provisions for attachment to tooth paste tubes.

Another object of the invention is to provide a captive cap including a lead portion to facilitate tooth paste being wiped off cleanly using tooth brush bristles.

Another object of the invention is to provide a tooth paste tube closure which can be opened and closed easily with one hand.

Still another object of the invention is to provide a captive cap assembly incorporating integrally molded spring members which have a simple uniform cross-section.

These, together with the various ancillary objects and features of this invention, which will become apparent as the following description proceeds, are attained by this CAPTIVE CAP, preferred embodiments of which are illustrated in the accompanying drawing, by way of example only, wherein:

FIG. 4 is a front view of the captive cap taken along the plane of the line 4—4 in FIG. 1;

FIG. 5 is a rear view of the captive cap taken along the plane of the line 5—5 in FIG. 1;

FIG. 6 is a vertical sectional view taken along the plane of the line 6—6 in FIG. 1; and FIG. 7 is a side elevational view of the captive cap of FIG. 1 with the captive cap shown in the closed position.

Figure 1:
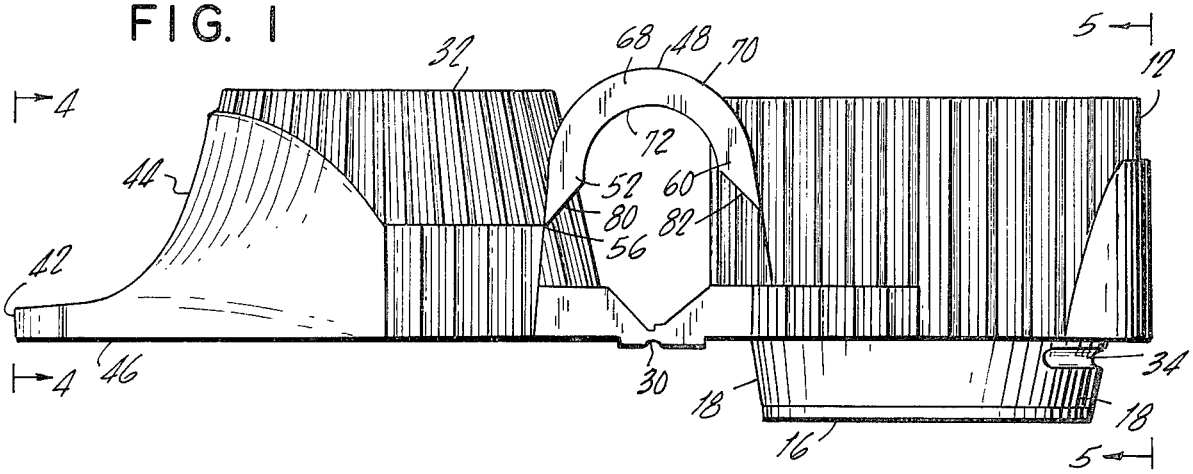
FIG. 1 is a side elevational view of a captive cap in accordance with the concepts of the present invention with the captive cap shown in the open position.
Figure 2:
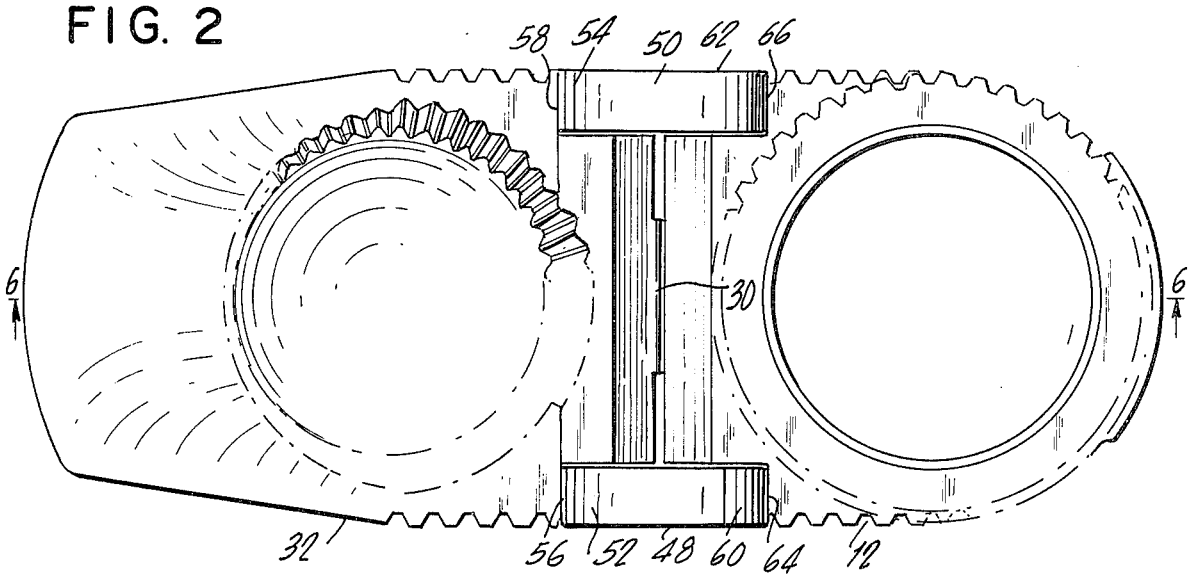
FIG. 2 is a top view of the captive cap of FIG. 1 with the captive cap shown in the open position.
Figure 3:
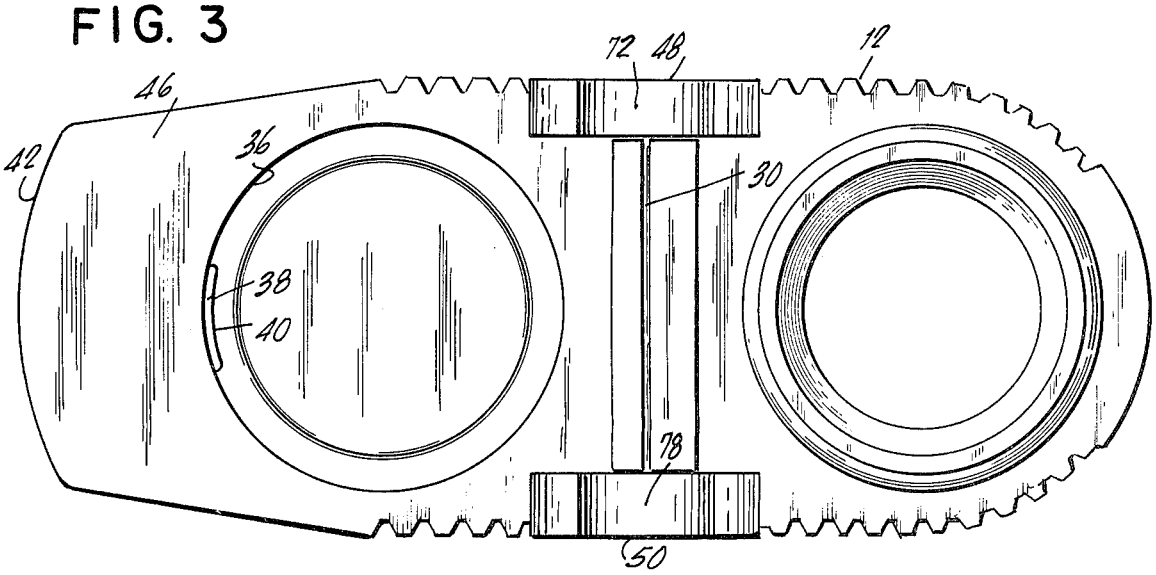
FIG. 3 is a bottom view of the captive cap of FIG. 1 with the cap shown in the open position.

With continuing reference to the accompanying drawing, wherein like reference numerals designate similar parts throughout the various views, reference numeral 10 is used to generally designate a captive cap constructed in accordance with the concepts of the present invention. Base 12 has a threaded inner portion 14 for threading the captive cap 10 onto a flexible tooth paste tube, which is not shown. A lead tube 16 is integrally formed on the base 12 and communicates with the threaded inner portion 14. The lead tube 16 extends from the base 12 and has a smooth outer surface 18 which tapers inwardly. This smooth outer surface 18 facilitates the clean wiping off of tooth paste which is extruded from the lead tube 16. The inner cylindrical surface 20 of the lead tube 16 has a narrowed portion 22 formed by tapered portions 24 and 26 and a cylindrical portion 28. The narrowed portion 22 facilitates the breaking off of a plug of extruded tooth paste. Hinge 30 joins the base 12 to the cap 32. The hinges 30 is an integrally molded member formed in a manner to be presently described. A recess 34 is formed on the outer surface 18 of the lead tube 16 opposite the hinge 30.

The cap 32 has an inner hollow surface 36 which is proportioned to enclose the lead tube 16 when the captive cap 10 is in the closed position shown in FIG. 7. The inner hollow surface 36 of the cap 32 has the general configuration of a truncated cone. A protuberance 38 is disposed on the inner hollow surface 36 opposite the hinge 30. The protuberance 28 has a rounded surface 40. The protuberance 38 is proportioned to fit into the recess 34 when the cap 32 is in the closed position shown in FIG. 7 for the purpose of locking the cap to the base 12. An extending portion 42 of the cap 32 defined in part by the curved surface 44 projects outwardly from the cap 32 in a direction opposite from hinge 30. The curved surface 44 has a generally concave curvature to facilitate the lodging of a finger or a thumb of a user in order to close the cap 32. A flat surface 46 is provided on the extending portion 42 of the cap. The flat surface 46 extends beyond the contour of the base 12 to facilitate the cap 32 being opened by upward pressure on it, exerted by a user.

A pair of integrally molded spring members 48 and 50 are disposed, one each, on either side of the hinge 30. The ends 52 and 54 of the spring members 48 and 50, respectively, are connected to the cap 32 by hinges 56 and 58, respectively. The ends 60 and 62 of the spring members 48 and 50, respectively, are connected to the base 12 by hinges 64 and 66, respectively. The hinges 30, 56, 58, 64 and 66 are integrally molded portions of the captive cap 10. The hinges 30, 56, 58 64 and 66 are integrally molded thin layers of material which form a bending line and permit the adjacent relatively thicker and consequently more rigid portions to pivot relative to each other.

The captive cap 10 is molded using one of several synthetic thermoplastic materials having the desireable properties of flexibility and high tensile strength. Among the acceptable materials for this application are nylon and polypropylene. It has been found that thermoplastic materials having a highly crystalline structure undergo a process of cold stretching during the flexure of short thin layers such as the hinges 30, 56, 58, 64 and 66 and that this process increases the tensile and tearing strength of the material in the location of the flexure. This process permits the molding of a captive cap 10 in accordance with the present invention which will withstand a large number of opening and closing cycles.

The spring member 48 has a curved portion 68 which is bounded by parallel curved surfaces 70 and 72. The spring member 50 has a curved portion 74 which is bounded by parallel curved surfaces 76 and 78. The curved surfaces 70 and 76 are cylindrically curved surfaces generated by a common radius. The curved surfaces 72 and 78 are cylindrically curved surfaces generated by a common radius which is shorter than the radius which generates surfaces 70 and 76. The cross-section of the spring members 48 and 50 is rectangular and is substantially uniform throughout the length of the spring with the exception of the short tapered sections 80 and 82 on spring member 48 (and equivalent short tapered sections on spring member 50) which are adjacent to the hinges 56, 58, 64 and 66.

In the unstressed state, shown in FIG. 1, hinges 56, 58, 64 and 66 which join the base 12 and the cap 32 are located a distance above the hinges 56, 58, 64 and 66. A slight closing of the cap 32 onto the base 12 tends to increase the distance between hinges 58 and 66 and between hinges 56 and 64 thus causing the spring members 48 and 50 to urge the cap 32 and the base 12 toward the open position shown in FIG. 1. Continued manual pressure by a user tending to close the cap 32 onto the base 12 increases the distance between hinges 56 and 64 and between hinges 58 and 66 causing increased spring force tending to open the cap until an intermediate position, of the cap 32 and the base 12 is reached, beyond which, increased pressure tending to close the cap onto the base decreases the distance between hinges 56 and 64 and between hinges 58 and 66 causing the spring force to tend to close the cap 32 onto the base 12. When the cap 32 and the base 12 are in the closed position, shown in FIG. 7, the distance between hinges 56 and 64 and the distance between hinges 56 and 64 is substantially equal to the distance between these hinges when the cover and the base are in the open position shown in FIG. 1.

The configuration of the captive cap 10 in accordance with the present invention has particular advantages when applied as a closure for tooth paste tubes. When in the open position, shown in FIG. 1, the cap 32 is maintained by spring members 48 and 50 out of the way of the base 12. The lead tube 16 is completely exposed and the cap 32 is out of the way of a tooth brush onto which tooth paste can be extruded without interference. When the user has completed extruding tooth paste onto a tooth brush the lead tube 16 can be wiped off cleanly onto the tooth brush. The user then need only start pushing the cap 32 toward the closed position shown in FIG. 7 and, once past the intermediate position, the spring members 48 and 50 tend to assist the closing of the cap 32. Slight additional pressure on curved surface 44 forces protuberance 38 into recess 34 and locks the cap 32 onto the base 12.

Although the description of the captive cap 10 has proceeded with respect to the application as a closure for tooth paste tubes additional applications for the captive cap may be found equally advantageous including applications as a closure for a variety of products including: artist's oil pigments, cosmetic creams and medications.

The provision of spring members 48 and 50 joined to the cap 32 and to the base 12 by hinges results in several advantages over the configuration of the unitary hinge of U.S. Pat. No. 3,289,877. The fact that the spring member according to U.S. Pat. No. 3,289,877 has two distinct portions each having a distinct mode of action has been previously discussed above. In addition, the interface between the two distinct portions of the spring member must be carefully offset from the hinge both vertically and laterally for proper operation of the unitary hinge. This imposes a burden both in the design of the hinge and in the manufacture of the hinge. In contrast, the spring members 48 and 50 according to the concepts of the present invention are simple, uniform members which operate in a simple bending mode resulting in economy both in the design and the manufacture of this unit.

A latitude of modification, substitution and change is intended in the foregoing disclosure and in some instances, some features of the invention will be employed without a corresponding use of other features.

I claim:

1. A captive cap comprising a hollow base, a hollow lead tube projecting from and communicating with said hollow base, means for attaching said hollow base to a container, a cap having a hollow portion, said hollow lead tube projecting toward said cap and proportioned to reside within said cap when said cap is closed onto said hollow base, a hinge member disposed between said hollow base and said cap, at least one spring member disposed between said hollow base and said cap and spaced apart from said hinge member and with said spring member having a first end pivotally attached to said hollow base, a second end pivotally attached to said cap, and a curved portion joining said first end and said second end, said cap including a protuberance extending from the inner surface of said cap and said hollow base having a complimentary recess on its outer surface said protuberance being disposed to lodge in said complimentary recess when said cap is closed onto said hollow base for reversibly locking said cap onto said hollow base.

2. A captive cap according to claim 1, wherein said curved portion is bounded by two parallel cylindrically curved surfaces.

3. A captive cap according to claim 1, wherein there are a pair of spring members disposed spaced apart from said hinge portion and positioned one at each end of said hinge member.

4. A captive cap according to claim 1, wherein said spring member has a uniform cross-section.

5. A captive cap according to claim 1, wherein said cap, said base, said spring member and said hinge member comprise an integrally molded assembly.

6. A captive cap according to claim 5, wherein said pivotal attachment of said spring member to said hollow base and said cap comprise integrally molded members.

7. A captive cap comprising a hollow base, a hollow lead tube having an outer surface with a first conical configuration, projecting from and communicating with said hollow base, means for attaching said hollow base to a container, a cap having a hollow interior defined by an inner wall having a second conical configuration, said hollow lead tube projecting toward said cap and proportioned to reside within said cap when said cap is closed onto said hollow base, a hinge member disposed between said hollow base and said cap, at least one spring member disposed between said hollow base and said cap and spaced apart from said hinge member and with said spring member having afirst end pivotally attached to said hollow base, a second end pivotally attached to said cap, and a curved portion joining said first end and said second end, said first and second conical configurations being mutually parallel and complimentary, said cap including a protuberance extending from said inner wall and said hollow base having a complimentary recess on said outer surface, said protuberance being disposed to lodge in said complimentary recess when said cap is closed onto said hollow base for reversibly locking said cap onto said hollow base.

8. The captive cap of claim 7 wherein said recess is disposed oppositely from said hinge member.

9. The captive cap of claim 7 wherein said protuberance has a rounded surface.

* * * * *